US010242781B2

(12) United States Patent
Satoh et al.

(10) Patent No.: US 10,242,781 B2
(45) Date of Patent: Mar. 26, 2019

(54) METHOD FOR MANUFACTURING R-T-B BASED SINTERED MAGNET

(71) Applicant: HITACHI METALS, LTD., Tokyo (JP)

(72) Inventors: Teppei Satoh, Mishima-gun (JP); Futoshi Kuniyoshi, Mishima-gun (JP); Rintaro Ishii, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/565,435

(22) PCT Filed: Dec. 16, 2016

(86) PCT No.: PCT/JP2016/087561
§ 371 (c)(1),
(2) Date: Oct. 10, 2017

(87) PCT Pub. No.: WO2017/110680
PCT Pub. Date: Jun. 29, 2017

(65) Prior Publication Data

US 2018/0130580 A1 May 10, 2018

(30) Foreign Application Priority Data

Dec. 24, 2015 (JP) ..... 2015-251677
Feb. 26, 2016 (JP) ..... 2016-036272

(51) Int. Cl.
*B22F 3/00* (2006.01)
*B22F 3/24* (2006.01)
(Continued)

(52) U.S. Cl.
CPC ..... *H01F 1/0577* (2013.01); *B22F 3/00* (2013.01); *B22F 3/24* (2013.01); *C21D 6/00* (2013.01);
(Continued)

(58) Field of Classification Search
CPC ..... H01F 1/057; H01F 1/0577; H01F 41/02; H01F 41/0293; C21D 6/00; C21D 6/007;
(Continued)

(56) References Cited

U.S. PATENT DOCUMENTS 9,177,705 B2 * 11/2015 Hidaka ..... C22C 38/06
2002/0054824 A1 5/2002 Tokoro et al.
(Continued)

FOREIGN PATENT DOCUMENTS

EP 2226137 A1 * 9/2010 ..... B22D 11/0611
EP 2226137 A1 9/2010
(Continued)

OTHER PUBLICATIONS

Written Opinion of the International Searching Authority of PCT/JP2016/087561 dated Feb. 28, 2017.
(Continued)

*Primary Examiner* — Keith Walker
*Assistant Examiner* — John A Hevey
(74) *Attorney, Agent, or Firm* — Sughrue Mion, PLLC

(57) ABSTRACT

A method for manufacturing an R-T-B based sintered magnet includes: 1) a step of preparing an R-T-B based sintered magnet material by sintering a molded body at a temperature of 1,000° C. or higher and 1,100° C. or lower, and then performing (a) temperature dropping to 500° C. at 10° C./min or less, or (b) temperature dropping to 500° C. at 10° C./min or less after performing a first heat treatment of holding at a first heat treatment temperature of 800° C. or higher and 950° C. or lower, the R-T-B based sintered magnet material satisfying compositional requirements; and 2) a heat treatment step of performing a second heat treatment by heating the R-T-B based sintered magnet material to a second heat treatment temperature of 650° C. or higher and 750° C. or lower, and then cooling the R-T-B based sintered magnet material to 400° C. at 5° C./min or more.

9 Claims, 2 Drawing Sheets

(51) Int. Cl.

| | |
|---|---|
| ***C21D 6/00*** | (2006.01) |
| ***C22C 38/00*** | (2006.01) |
| ***H01F 1/057*** | (2006.01) |
| ***H01F 41/02*** | (2006.01) |

(52) U.S. Cl.
CPC ..... *C21D 6/007* (2013.01); *C22C 38/00* (2013.01); *H01F 1/057* (2013.01); *H01F 41/02* (2013.01); *H01F 41/0293* (2013.01); *B22F 2003/248* (2013.01); *C22C 38/005* (2013.01)

(58) Field of Classification Search
CPC ..... B22F 3/00; B22F 3/24; B22F 2003/248; C22C 38/00; C22C 38/005
See application file for complete search history.

(56) References Cited

U.S. PATENT DOCUMENTS

| | | | | |
|---|---|---|---|---|
| 2010/0230013 | A1 | 9/2010 | Nakajima | |
| 2014/0132377 | A1 | 5/2014 | Nakajima et al. | |
| 2014/0184370 | A1 | 7/2014 | Hidaka et al. | |
| 2014/0375404 | A1* | 12/2014 | Kuniyoshi | C22C 30/00 335/302 |
| 2016/0284468 | A1 | 9/2016 | Yamagata et al. | |
| 2017/0025207 | A1 | 1/2017 | Nakajima et al. | |

FOREIGN PATENT DOCUMENTS

| | | | | | |
|---|---|---|---|---|---|
| JP | 60-255941 | A | | 12/1985 | |
| JP | 60255941 | A | * | 12/1985 | |
| JP | 2009-302262 | A | | 12/2009 | |
| WO | 2012/161355 | A1 | | 11/2012 | |
| WO | 2013/008756 | A1 | | 1/2013 | |
| WO | WO-2013108830 | A1 | * | 7/2013 | C22C 30/00 |
| WO | 2015/030231 | A1 | | 3/2015 | |

OTHER PUBLICATIONS

International Search Report of PCT/JP2016/087561 dated Feb. 28, 2017.
Communication dated May 24, 2018, issued by the German Patent Office in counterpart German Application No. 112016001090.7.

* cited by examiner

METHOD FOR MANUFACTURING R-T-B BASED SINTERED MAGNET

CROSS REFERENCE TO RELATED APPLICATIONS

This application is a National Stage of International Application No. PCT/JP2016/087561 filed Dec. 16, 2016 (claiming priority based on Japanese Patent Application No. 2015-251677 filed Dec. 24, 2015 and Japanese Patent Application No. 2016-036272 filed Feb. 26, 2016), the contents of which are incorporated herein by reference in their entirety.

TECHNICAL FIELD

The present invention relates to a method for manufacturing an R-T-B based sintered magnet.

BACKGROUND ART

An R-T-B based sintered magnet (where R is at least one of rare earth elements, indispensably containing Nd, and T is a transition metal element, indispensably containing Fe) is composed of a main phase made of a compound having an $R_2T_{14}B$ type crystal structure and a grain boundary phase located at a grain boundary portion of this main phase, which is known as a magnet with the highest performance among permanent magnets.

Therefore, this type of magnet is used in various applications such as voice coil motors (VCM) of hard disk drives, motors for electric automobile (EV, HV, PHV), and motors for industrial equipment, and home appliance.

With the expansion of applications, the motor for electric automobile is sometimes exposed to high temperature in a range of 100° C. to 160° C., thus requiring a stable operation even at high temperature.

However, the R-T-B based sintered magnet has its coercive force $H_{cJ}$ (hereinafter simply referred to as "$H_{cJ}$" in some cases) reduced at high temperatures, leading to irreversible thermal demagnetization. When the R-T-B based sintered magnet is used in motors for electric automobile, use of the R-T-B based sintered magnet at high temperature leads to a reduction in $H_{cJ}$, thus failing to obtain a stable operation of the motor. Therefore, there is required an R-T-B based sintered magnet which has high $H_{cJ}$ at room temperature and also high $H_{cJ}$ at high temperature.

Conventionally, to improve $H_{cJ}$ at room temperature, heavy rare earth elements (mainly Dy) have been added to the R-T-B based sintered magnet. However, this results in a problem that a residual magnetic flux density $B_r$ (hereinafter simply referred to as "$B_r$" in some cases) is reduced. Dy has various issues, including inconsistent supply and large fluctuations in price due to restricted areas where their resources are located, and the like. For this reason, users request technology which enables an improvement in $H_{cJ}$ of R-T-B based sintered magnets without using heavy rare-earth elements RH, such as Dy, as much as possible.

Patent Document 1 discloses, as such technology, technology in which the B content is set lower than that in the standard R-T-B based alloy, while at least one element selected from Al, Ga, and Cu is contained as a metal element M to thereby form an $R_2T_{17}$ phase, thus ensuring an adequate volume ratio of a transition metal-rich phase ($R_6T_{13}M$) formed using the $R_2T_{17}$ phase as a raw material, whereby an R-T-B based rare-earth sintered magnet with high coercivity can be obtained while reducing the Dy content.

PRIOR ART DOCUMENT

Patent Document

Patent Document 1: WO 2013/008756 A

DISCLOSURE OF THE INVENTION

Problems to be Solved by the Invention

However, the R-T-B based sintered magnet mentioned in Patent Document 1 had a problem that a squareness ratio $H_k/H_{cJ}$ (hereinafter simply referred to as "$H_k/H_{cJ}$" in some cases) is not sufficiently high as compared with other conventional R-T-B based sintered magnet (with conventional B content), although $H_{cJ}$ is improved. As mentioned in Table 4 to Table 6 of Patent Document 1, the R-T-B based sintered magnet mentioned in Patent Document 1 exhibits a squareness ratio (Sq (square-shape property) in Patent Document 1) of 95% at most, and often exhibits a squareness ratio of around 80% when containing a heavy rare earth element RH (Dy), so that it is difficult to say that high-level squareness ratio is achieved. Commonly, low squareness ratio leads to a problem that irreversible thermal demagnetization is likely to occur during use at high temperature, thus requiring an R-T-B based sintered magnet which has high $H_{cJ}$ and also has high $H_k/H_{cJ}$. Although Patent Document 1 does not mention definition of the squareness ratio, JP 2007-119882 A by the same applicant cited as prior art document of Patent Document 1 mentions the squareness ratio as a "value expressed by percent, which is obtained by dividing a value of an external magnetic field in which magnetization accounts for 90% of saturation magnetization by iHc", so that definition of the squareness ratio of Patent Document 1 is considered to be the same. In other words, definition of the squareness ratio of Patent Document 1 is considered to be the same as definition that is commonly used.

Accordingly, it is an object of the present invention to provide a method for manufacturing an R-T-B based sintered magnet with high coercive force $H_{cJ}$ and high squareness ratio $H_k/H_{cJ}$ while reducing the content of a heavy rare earth element RH.

Means for Solving the Problems

A first aspect of the present invention is directed to a method for manufacturing an R-T-B based sintered magnet, which includes: 1) a step of preparing an R-T-B based sintered magnet material by sintering a molded body at a temperature of 1,000° C. or higher and 1,100° C. or lower, and then performing (condition a) or (condition b) below: (Condition a) temperature dropping to 500° C. at 10° C./min or less, and (Condition b) temperature dropping to 500° C. at 10° C./min or less after performing a first heat treatment of holding at a first heat treatment temperature of 800° C. or higher and 950° C. or lower, the R-T-B based sintered magnet material including: 27.5% by mass or more and 34.0% by mass or less of R, (R being at least one element of rare earth elements and indispensably containing Nd); 0.85% by mass or more and 0.93% by mass or less of B, 0.20% by mass or more and 0.70% by mass or less of Ga, 0.05% by mass or more and 0.50% by mass or less of Cu, and 0.05% by mass or more and 0.50% by mass or less of Al, with the balance being T (T being Fe and Co, and 90% or more of T in terms of a mass ratio being Fe) and inevitable impurities, the R-T-B based sintered magnet material satisfying inequality expressions (1) and (2) below:

$$[T]-72.3[B]>0 \quad (1)$$

$$([T]-72.3[B])/55.85<13[Ga]/69.72 \quad (2)$$

where [T] is a T content in % by mass, [B] is a B content in % by mass, and [Ga] is a Ga content in % by mass; and 2) a heat treatment step of performing a second heat treatment by heating the R-T-B based sintered magnet material to a second heat treatment temperature of 650° C. or higher and 750° C. or lower, and then cooling the R-T-B based sintered magnet material to 400° C. at 5° C./min or more.

A second aspect of the present invention is directed to the method for manufacturing an R-T-B based sintered magnet according to the first aspect, wherein, in the step 2), the R-T-B based sintered magnet material is cooled from the second heat treatment temperature to 400° C. at 15° C./min or more.

A third aspect of the present invention is directed to the method for manufacturing an R-T-B based sintered magnet according to the first aspect, wherein, in the step 2), the R-T-B based sintered magnet material is cooled from the second heat treatment temperature to 400° C. at 50° C./min or more.

A fourth aspect of the present invention is directed to the method for manufacturing an R-T-B based sintered magnet according to any one of the first to third aspects, wherein the R-T-B based sintered magnet material includes 1.0% by mass or more and 10% by mass or less of Dy and/or Tb.

A fifth aspect of the present invention is directed to the method for manufacturing an R-T-B based sintered magnet according to any one of the first to fourth aspects, wherein, in the step 1) (condition b), after sintering and cooling to a temperature lower than the first heat treatment temperature, the first heat treatment is performed by heating to the first heat treatment temperature.

A sixth aspect of the present invention is directed to the method for manufacturing an R-T-B based sintered magnet according to any one of the first to fifth aspects, wherein, in the step 1) (condition b), after sintering and cooling to the first heat treatment temperature, the first heat treatment is performed.

A seventh aspect of the present invention is directed to the method for manufacturing an R-T-B based sintered magnet according to any one of the first to sixth aspects, which comprises a low-temperature heat treatment step of heating the R-T-B based sintered magnet after the step 2) to a low-temperature heat treatment temperature of 360° C. or higher and 460° C. or lower.

Effects of the Invention

According to the present invention, it is possible to provide a method for manufacturing an R-T-B based sintered magnet with high coercive force $H_{cJ}$ and high squareness ratio $H_k/H_{cJ}$ while reducing the content of a heavy rare earth element RH.

MODE FOR CARRYING OUT THE INVENTION

Figure 1:
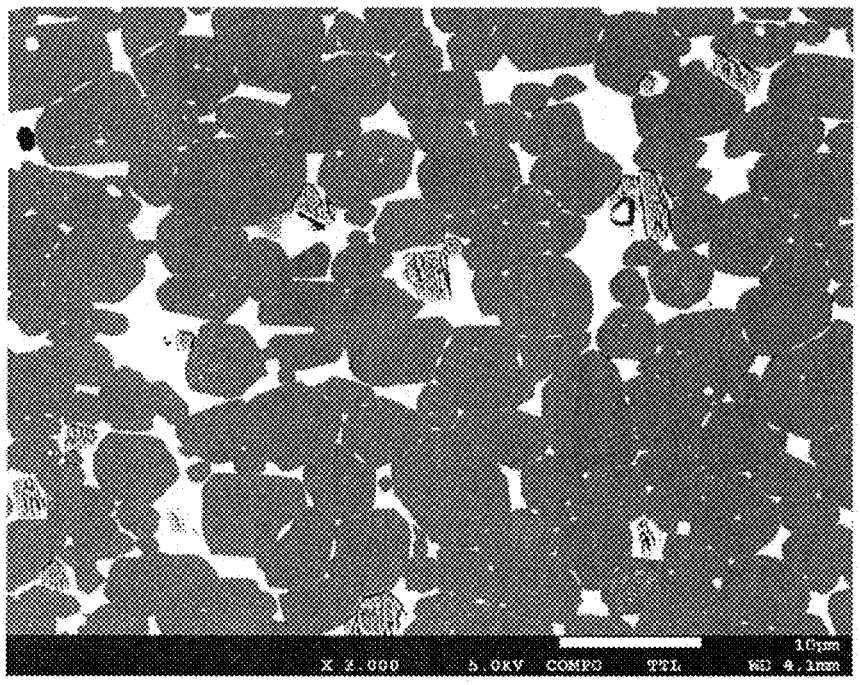
FIG. 1 is a photograph of a reflected electron image taken by FE-SEM of a specimen No. 1.

The following embodiments are illustrative only to exemplify a method for manufacturing an R-T-B based sintered magnet to embody the technical idea of the present invention, and hence the present invention is not limited thereto. The size, material, shape, relative arrangement, etc., of each component mentioned in the embodiments are not intended to limit the scope of the present invention only thereto, unless otherwise specified, and further intended to exemplify the present invention. The size, positional relationship, and the like of members shown in some drawings are emphasized to make the contents easily understood.

The inventors of the present application have intensively studied and found that it is possible to obtain an R-T-B based sintered magnet with high coercive force $H_{cJ}$ and high squareness ratio $H_k/H_{cJ}$ by performing, as the step 1), a step of sintering a molded body, prepared so that the R-T-B based sintered magnet material has a predetermined composition mentioned below, at a temperature of 1,000° C. or higher and 1,100° C. or lower, and then performing the condition below:

(Condition a) temperature dropping to 500° C. at 10° C./min or less, or (Condition b) temperature dropping to 500° C. at 10° C./min or less after performing a first heat treatment of holding at a first heat treatment temperature of 800° C. or higher and 950° C. or lower; and performing, as the step 2), a heat treatment step of performing a second heat treatment by heating the R-T-B based sintered magnet material to a second heat treatment temperature of 650° C. or higher and 750° C. or lower, and then cooling the R-T-B based sintered magnet material to 400° C. at 5° C./min or more. Thus, the present invention has been made. In the present invention, a squareness ratio $H_k/H_{cJ}$ means a value expressed by percent, which is obtained by dividing a value of an external magnetic field in which magnetization accounts for 90% of saturation magnetization by $_iH_c$. Temperature notations, such as the sintering temperature of the molded body; the temperature dropping rate and the temperature dropping temperature in (condition a); the first heat treatment temperature, the cooling temperature, and the temperature dropping rate in (condition b); and the second heat treatment temperature, the cooling temperature, and the temperature dropping rate in the heat treatment step, defined in the present invention, are respectively defined by the temperature on a surface of the molded body and the R-T-B based sintered magnet material themselves, and they can be measured by installing a thermocouple on a surface of the molded body and the R-T-B based sintered magnet material.

There are still unclear points regarding the mechanism in which an R-T-B based sintered magnet with high $H_{cJ}$ and high $H_k/H_{cJ}$ is obtained by applying a specific heat treatment to the R-T-B based sintered magnet material with a specific composition shown in the first aspect of the present invention. A description will be given on the mechanism the inventors of the present application come up with based on findings currently obtained. It should be noted that the description on following mechanism supposed by the inventors of the present application based on the findings currently obtained, and not intended to limit the scope of the present invention.

According to the method mentioned in Patent Document 1, the B content is set lower than a stoichiometric ratio of an $R_2T_{14}B$ type compound to thereby form an $R_2T_{17}$ phase, and Ga is added to thereby form an R-T-Ga phase ($R_6T_{13}M$), thus improving $H_{cJ}$. However, as a result of the study of the inventors of the present application, it has been found that the $R_2T_{17}$ phase remains in the obtained R-T-B based sintered magnet even if Ga is added, so that the remaining $R_2T_{17}$ phase causes degradation of $H_{cJ}$ and $H_k/H_{cJ}$ in some cases. It has also been found that an R-T-Ga phase also has slight magnetism and, if a large amount of the R-T-Ga phase exists in the grain boundary between two phases, which is considered to exert an influence mainly on $H_{cJ}$ and $H_k/H_{cJ}$, among the first grain boundary existing between two main phases (hereinafter referred to as a "grain boundary between two phases" in some cases) in the R-T-B based sintered magnet and the second grain boundary existing among three or more main phases (hereinafter referred to as a "triple-points grain boundary" in some cases), an improvement in $H_{cJ}$ and $H_k/H_{cJ}$ is disturbed. It has also been found that an R—Ga—Cu phase, which is considered to have lower magnetism than that of the R-T-Ga phase, is formed in the grain boundary between two phases, along with the formation of the R-T-Ga phase. Therefore, to obtain an R-T-B based sintered magnet with high $H_{cJ}$ and high $H_k/H_{cJ}$, there is a need to form the R-T-Ga phase, while it was assumed to be important to prevent remaining of the $R_2T_{17}$ phase and to form a large amount of the R—Ga—Cu phase in the grain boundary between two phases. On this assumption, the inventors have further studied and found it is possible to obtain an R-T-B based sintered magnet with high $H_{cJ}$ and high $H_k/H_{cJ}$ by performing both the steps 1) and 2) to specific composition of the present invention. It is considered that the R-T-Ga phase can be formed without remaining the $R_2T_{17}$ phase by performing the step of (condition a) or (condition b) after sintering of the step 1), that is, performing slow cooling (temperature dropping to 500° C. at 10° C./min or less) after sintering, or after sintering and the first heat treatment. It is also considered that the R-T-Ga phase is partially melted by performing the step 2), that is, the step of cooling to 400° C. at 5° C./min or more after the second heat treatment at 650° C. or higher and 750° C. or lower, and R and Ga thus melted and Cu existing in the grain boundary between two phase enable the formation of a large amount of an R—Ga—Cu phase in the grain boundary between two phases. Therefore, it is considered to be possible to form an R-T-Ga phase without remaining the $R_2T_{17}$ phase and to form a large amount of an R—Ga—Cu phase in the grain boundary between two phases by performing both the steps 1) and 2), thus obtaining an R-T-B based sintered magnet with high $H_{cJ}$ and high $H_k/H_{cJ}$.

The R-T-Ga phase as used herein includes: 15% by mass or more and 65% by mass or less of R, 20% by mass or more and 80% by mass or less of T, and 2% by mass or more and 20% by mass or less of Ga, and examples thereof include an $R_6Fe_{13}Ga$ compound. The $R_6Fe_{13}Ga$ compound is converted to form an $R_6T_{13-\delta}Ga_{1+\delta}$ compound in some cases, depending on the situation. Since the R-T-Ga phase includes Al and Cu, and Si as inevitable impurities, trapped thereinto in some cases, the R-T-Ga compound is converted to form an $R_6Fe_{13}$ ($Ga_{1-x-y-z}Cu_xAl_ySi_z$) compound is some cases. The R—Ga—Cu phase is configured by substituting Cu for part of Ga of the R—Ga phase, and includes: 70% by mass or more and 95% by mass or less of R, 5% by mass or more and 30% by mass or less of Ga, and 20% by mass or less (including 0) of T (Fe), and examples thereof include an $R_3(Ga,Cu)_1$ compound.

The respective steps in the method for manufacturing an R-T-B based sintered magnet according to the embodiments of the present invention will be described in detail below.

1. Step of Preparing R-T-B Based Sintered Magnet Material

The term "R-T-B based sintered magnet material" as used herein means a sintered body obtained by sintering a molded body at a temperature of 1,000° C. or higher and 1,100° C. or lower, followed by (Condition a) temperature dropping to 500° C. at 10° C./min or less, or (Condition b) temperature dropping to 500° C. at 10° C./min or less after performing a first heat treatment of holding at a first heat treatment temperature of 800° C. or higher and 950° C. or lower. By this step, an R-T-B based sintered magnet material, which is a sintered magnet material with a predetermined composition, can be obtained. The thus obtained R-T-B based sintered magnet material is further subjected to a second heat treatment in a heat treatment step which is mentioned in detail below.

The step mentioned below exemplifies the step of preparing an R-T-B based sintered magnet material. That is, there is a possibility that persons skilled in the art, who understood desired properties of the above-mentioned R-T-B based sintered magnet according to the present invention, can find a method for manufacturing an R-T-B based sintered magnet having desired properties according to the present invention, except for a manufacturing method mentioned below, as a result of repeating trial and error.

1-1. Composition of R-T-B Based Sintered Magnet Material

First, a description is made on the composition of the R-T-B based sintered magnet material according to the embodiment of the present invention.

The R-T-B based sintered magnet material according to the embodiment of the present invention includes: 27.5% by mass or more and 34.0% by mass or less of R (R being at least one element of rare earth elements and indispensably containing Nd), 0.85% by mass or more and 0.93% by mass or less of B, 0.20% by mass or more and 0.70% by mass or less of Ga, 0.05% by mass or more and 0.50% by mass or less of Cu, and 0.05% by mass or more and 0.50% by mass or less of Al, with the balance being T (T being Fe and Co, and 90% or more of T in terms of a mass ratio being Fe) and inevitable impurities, the R-T-B based sintered magnet material satisfying inequality expressions (1) and (2) below:

$$[T]-72.3[B]>0 \quad (1)$$

$$([T]-72.3[B])/55.85<13[Ga]/69.72 \quad (2)$$

where [T] is a T content in % by mass, [B] is a B content in % by mass, and [Ga] is a Ga content in % by mass.

The R-T-B based sintered magnet (R-T-B based sintered magnet material) in the embodiment of the present invention may contain inevitable impurities. Even if the R-T-B based sintered magnet contains inevitable impurities, which normally tend to be trapped in a melted raw material, for example, a didymium alloy (Nd—Pr), an electrolytic iron, ferroboron, etc., the effects of the present invention can be sufficiently exerted. Examples of the inevitable impurities include La, Ce, Cr, Mn, Si, etc.

Next, details of each element will be described.

1) Rare Earth Element (R)

R in the R-T-B based sintered magnet according to the embodiment of the present invention is at least one of rare earth elements, and indispensably contains Nd. The R-T-B based sintered magnet according to the embodiment of the present invention can achieve high $B_r$ and high $H_{cJ}$ even when a heavy rare earth element (RH) is not contained therein. Thus, even when the higher $H_{cJ}$ is required, the amount of added RH can be reduced. When the R content is less than 27.5% by mass, high $H_{cJ}$ might not be obtained. When the R content exceeds 34.0% by mass, the ratio of the main phase is reduced, failing to obtain high $B_r$. Thus, to obtain higher $B_r$, the R content is preferably 31.0% by mass or less.

2) Boron (B)

When the B content is less than 0.85% by mass, the amount of a formed $R_2T_{17}$ phase becomes too large, so that the $R_2T_{17}$ phase remains in the thus obtained R-T-B based sintered magnet, and high $H_{cJ}$ and high $H_k/H_{cJ}$ might not be obtained. Furthermore, the ratio of the main phase is reduced, failing to obtain high $B_r$. When the B content exceeds 0.93% by mass, the amount of formed R-T-Ga phase is so small that high $H_{cJ}$ might not be obtained.

3) Transition Metal Element (T)

T is Fe and Co, with 90% or more of T in terms of a mass ratio being Fe. Furthermore, as inevitable impurities, a small amount of transition metal elements, such as Zr, Nb, V, Mo, Hf, Ta, or W, may be contained as long as the effect of the present invention is not impaired. When the ratio of Fe to T in terms of a mass ratio is less than 90%, $B_r$ might be drastically degraded. An example of another transition metal element other than Fe includes, for example, Co. Note that the amount of substitution of Co is preferably 2.5% or less in the total T in terms of a mass ratio. When the amount of substitution of Co exceeds 10% in the total T in terms of a mass ratio, $B_r$ is degraded, which is not preferable.

4) Gallium (Ga)

When the Ga content is less than 0.2% by mass, the formation amounts of the R-T-Ga phase and the R—Ga—Cu phase are extremely small, thus failing to obtain high $H_{cJ}$. When the Ga content exceeds 0.70% by mass, unnecessary Ga exists, and thereby the ratio of the main phase might be decreased, leading to the reduction in $B_r$.

5) Copper (Cu)

When the Cu content is less than 0.05% by mass, the amount of a formed R—Ga—Cu phase becomes small, thus failing to obtain high $H_{cJ}$. When the Cu content exceeds 0.50% by mass, the ratio of the main phase is reduced, resulting in a decrease in the $B_r$.

6) Aluminum (Al)

The Al content is 0.05% by mass or more and 0.50% by mass or less. Al is contained in the R-T-B based sintered magnet, whereby the $H_{cJ}$ can be improved. Al may be contained as an inevitable impurity, or alternatively may be positively added. The total amount of Al contained as the inevitable impurity and positively added is set at 0.05% by mass or more and 0.50% by mass or less.

7) Dysprosium (Dy), Terbium (Tb)

The R-T-B based sintered magnet material according to the embodiment of the present invention may contain 1.0% by mass or more and 10% by mass or less of Dy and/or Tb. When containing Dy and/or Tb in the amount within this range, an R-T-B based sintered magnet with higher $H_{cJ}$ and $H_k/H_{cJ}$ can be obtained after subjecting the R-T-B based sintered magnet material to a second heat treatment.

8) Inequality Expressions (1) and (2)

The composition of the R-T-B based sintered magnet material in the embodiment of the present invention satisfies the inequality expressions (1) and (2) below, so that the B content is set lower than that of a standard R-T-B based sintered magnet. The standard R-T-B based sintered magnet is designed to have the composition in which [Fe]/55.847 (atomic weight of Fe) is smaller than [B]/10.811 (atomic weight of B)×14 in order to prevent the precipitation of a soft magnetic phase of the $R_2T_{17}$ phase other than the main phase of $R_2T_{14}B$ phase ([ ] means the content of an element mentioned inside the parentheses in percent by mass. For example, [Fe] means the content of Fe in percent by mass). Unlike the standard R-T-B based sintered magnet, the R-T-B based sintered magnet according to the embodiment of the present invention is configured to have the composition that satisfies the inequality expression (1) such that [Fe]/55.847 (atomic weight of Fe) is larger than [B]/10.811 (atomic weight of B)×14 (55.847/10.811×14=72.3). Furthermore, the R-T-B based sintered magnet in the embodiment of the present invention is configured to have the composition that satisfies the inequality expression (2) such that ([T]−72.3B)/55.85 (atomic weight of Fe) is smaller than 13Ga/69.72 (atomic weight of Ga) in order to precipitate the R-T-Ga phase by suppressing formation of the $R_2T_{17}$ phase from excess Fe and including Ga. The R-T-B based sintered magnet material is adapted to have the composition that satisfies the above-mentioned inequality expressions (1) and (2), and to be subjected to the heat treatment step to be mentioned below, so that the R—Ga—Cu phase can be formed without remaining the $R_2T_{17}$ phase, and without excessively forming the R-T-Ga phase. Note that although T is Fe and Co, in the embodiment of the present invention, Fe is a main component (in the content of 90% or more in terms of a mass ratio) in T. This is why the atomic weight of Fe is used. With this arrangement, the R-T-B based sintered magnet in the present invention can achieve high $H_{cJ}$ while reducing the use of the heavy rare earth element, such as Dy, as much as possible.

$$[T]-72.3[B]>0 \quad (1)$$

$$([T]-72.3[B])/55.85<13[Ga]/69.72 \quad (2)$$

where [T] is a T content in % by mass, [B] is a B content in % by mass, and [Ga] is a Ga content in % by mass.

1-2. Step of Preparing Molded Body

Next, a step of preparing a molded body will be described.

In the step of preparing a molded body, respective metals or alloys (melted raw materials) are prepared such that the R-T-B based sintered magnet material has the composition to be mentioned above, and then the prepared metals or alloys may be processed by a strip casting method or the like to thereby fabricate a flake raw alloy. Then, an alloy powder is fabricated from the flake raw alloy. Subsequently, the alloy powder may be formed to thereby obtain a molded body.

The production of the alloy powder and the formation of the molded body may be performed by way of example as follows.

The obtained flake raw alloy is subjected to hydrogen grinding, thereby obtaining coarse ground particles, for example, each having a size of 1.0 mm or less. Then, the coarse ground particles are further pulverized finely by a jet mill or the like in an inert gas, thereby obtaining a fine pulverized powder (alloy powder) having a particle size $D_{50}$ of 3 to 5 μm (which is a volume central value (volume-based median diameter) obtained by measurement in an airflow dispersion laser diffraction method). The alloy powder may be one kind of an alloy powder (single alloy powder) or a mixture of two or more kinds of alloy powders (mixed alloy powder) obtained by the so-called two-alloy method. The alloy powder may be fabricated by any well-known method to have the composition specified by the embodiments of the present invention.

A well-known lubricant may be respectively added as an auxiliary agent to the coarse ground powder before the jet mill pulverization and to the alloy powder during and after the jet mill pulverization. Then, the thus obtained alloy powder is formed under a magnetic field, thereby obtaining a molded body. The forming may be performed by arbitrary well-known forming methods, which include a dry forming method in which dry alloy powder is inserted into a cavity of a die and molded, and a wet forming method in which a slurry containing an alloy powder is charged into a cavity of a die, and a dispersion medium of the slurry is discharged therefrom, thereby producing a molded body by using the remaining alloy powder.

1-3. Step of Sintering Molded Body and Subjecting to Heat Treatment

The molded body thus prepared is sintered at a temperature of 1,000° C. or higher and 1,100° C. or lower, and then subjected to a heat treatment defined in (condition a) or (condition b) below, thus making it possible to obtain an R-T-B based sintered magnet material according to the embodiment of the present invention:

(Condition a) temperature dropping to 500° C. at 10° C./min or less, or (Condition b) temperature dropping to 500° C. at 10° C./min or less after performing a first heat treatment of holding at a first heat treatment temperature of 800° C. or higher and 950° C. or lower.

Regarding Sintering Temperature

In this embodiment, when the sintering temperature is lower than 1,000° C., sintered density is insufficient, thus failing to obtain high $B_r$. Therefore, the sintering temperature of the molded body according to the embodiment of the present invention is 1,000° C. or higher, and preferably 1,030° C. or higher. When the sintering temperature exceeds 1,100° C., the grain growth of the main phase occurs rapidly, thus failing to obtain an R-T-B based sintered magnet with high $H_{cJ}$ and high $H_k/H_{cJ}$ by the subsequent heat treatment. Therefore, the sintering temperature of the molded body according to the embodiment of the present invention is 1,100° C. or lower, and preferably 1,080° C. or lower.

Sintering of the molded body can be performed by the well-known methods. To prevent oxidization in an atmosphere during sintering, the sintering is preferably performed in a vacuum atmosphere or atmosphere gas. The atmosphere gas preferably uses inert gases, such as helium or argon.

Regarding Heat Treatment

[(Condition a) Temperature Dropping to 500° C. at 10° C./Min or Less]

The R-T-B based sintered magnet material according to the embodiment of the present invention can be obtained by temperature dropping to 500° C. at a temperature dropping rate of 10° C./min or less after sintering a molded body as mentioned above.

The R-T-B based sintered magnet material thus obtained is subjected to a heat treatment step which is mentioned in detail below, thus making it possible to obtain an R-T-B based sintered magnet with high $H_{cJ}$ and high $H_k/H_{cJ}$.

The temperature dropping rate to 500° C. (10° C./min or less) is evaluated by an average cooling rate from the sintering temperature to 500° C. (that is, a value obtained by dividing a temperature difference between the sintering temperature and 500° C. by a time during which the temperature is dropped from the sintering temperature to 500° C.).

After sintering the molded body, the temperature is dropped to 500° C. at a temperature dropping rate of 10° C./min or less, whereby, an R-T-Ga phase can be formed without remaining an $R_2T_{17}$ phase, and it is possible to obtain an R-T-B based sintered magnet with high $H_{cJ}$ and high $H_k/H_{cJ}$ by the subsequent heat treatment step. After sintering the molded body, when the temperature dropping rate to 500° C. exceeds 10° C./min, a part of the $R_2T_{17}$ phase is formed, thus failing to obtain an R-T-B based sintered magnet with high $H_{cJ}$ and high $H_k/H_{cJ}$ by the subsequent heat treatment step. Therefore, in the embodiment of the present invention, after sintering the molded body, the temperature dropping rate to 500° C. is 10° C./min or less, and preferably 5° C./min or less.

After sintering, cooling from the temperature of lower than 500° C. may be performed at an arbitrary cooling rate, and cooling may be either slow cooling (for example, 10° C./min or less) or rapid cooling (for example, 40° C./min or more). After sintering and temperature dropping to 500° C. at a cooling rate of 10° C./min or less, cooling to room temperature may be performed, or a heat treatment step mentioned below may be continuously performed.

[(Condition b) Temperature Dropping to 500° C. at 10° C./Min or Less after Performing First Heat Treatment of Holding at First Heat Treatment Temperature of 800° C. or Higher and 950° C. or Lower]

It is also possible to obtain an R-T-B based sintered magnet material according to the embodiment of the present invention by sintering a molded body, as mentioned above, and performing a first heat treatment while holding at a first heat treatment temperature of 800° C. or higher and 950° C. or lower, followed by temperature dropping to 500° C. at 10° C./min or less.

The R-T-B based sintered magnet material thus obtained is subjected to a heat treatment step which is mentioned in detail below, thus making it possible to obtain an R-T-B based sintered magnet with high $H_{cJ}$ and high $H_k/H_{cJ}$.

A method of evaluating the temperature dropping rate (10° C./min or less) of temperature dropping to 500° C. in use may involve evaluating an average cooling rate from the first heat treatment temperature to 500° C. (that is, a value obtained by dividing a temperature difference between the first heat treatment temperature and 500° C. by a time during which the temperature is dropped from the first heat treatment temperature to 500° C.).

Regarding the first heat treatment at the first heat treatment temperature, after sintering a molded body at a temperature of 1,000° C. or higher and 1,100° C. or lower and cooling to a temperature of lower than the first heat treatment temperature, the first heat treatment may be performed by heating to the first heat treatment temperature.

After sintering a molded body at a temperature of 1,000° C. or higher and 1,100° C. or lower, the first heat treatment may be performed by cooling to the first heat treatment temperature without cooling to a temperature of lower than the first heat treatment temperature. Regarding cooling the molded body after sintering to the first heat treatment, cooling may be performed at an arbitrary cooling rate, or cooling may be either slow cooling (for example, 10° C./min or less) or rapid cooling (for example, 40° C./min or more).

In this embodiment, the first heat treatment is performed by holing at the first heat treatment temperature of 800° C. or higher and 950° C. or lower, thus enabling the formation of an R-T-Ga phase can be formed while suppressing the formation of an $R_2T_{17}$ phase, and it is possible to obtain an R-T-B based sintered magnet with high $H_{cJ}$ and high $H_k/H_{cJ}$ by the subsequent second heat treatment mentioned below.

When the first heat treatment is performed at a temperature of lower than 800° C., the formation of the $R_2T_{17}$ phase is not suppressed because of too low temperature, leading to the existence of the $R_2T_{17}$ phase, thus failing to obtain an R-T-B based sintered magnet with high $H_{cJ}$ and high $H_k/H_{cJ}$ by the subsequent the second heat treatment.

When the first heat treatment temperature exceeds 950° C., the grain growth of the main phase occurs rapidly, thus failing to obtain an R-T-B based sintered magnet with high $H_{cJ}$ and high $H_k/H_{cJ}$ by the subsequent heat treatment. Therefore, the first heat treatment temperature according to the embodiment of the present invention is 950° C. or lower, and preferably 900° C. or lower.

After the first heat treatment, the temperature is dropped to 500° C. at a cooling rate of 10° C./min or less, whereby, an R-T-Ga phase can be formed without remaining an $R_2T_{17}$ phase, and it is possible to obtain an R-T-B based sintered magnet with high $H_{cJ}$ and high $H_k/H_{cJ}$ by the subsequent heat treatment step. After the first heat treatment, when the temperature dropping rate to 500° C. exceeds 10° C./min, the $R_2T_{17}$ phase is formed, thus failing to obtain an R-T-B based sintered magnet with high $H_{cJ}$ and high $H_k/H_{cJ}$. Therefore, in the embodiment of the present invention, after the first heat treatment, the temperature dropping rate to 500° C. is 10° C./min or less, and preferably 5° C./min or less.

After the first heat treatment, cooling from the temperature of lower than 500° C. may be performed at an arbitrary cooling rate, and cooling may be either slow cooling (for example, 10° C./min or less) or rapid cooling (for example, 40° C./min or more). After the first heat treatment and temperature dropping to 500° C. at a cooling rate of 10° C./min or less, cooling to room temperature may be performed, or a heat treatment step mentioned below may be continuously performed.

2. Heat Treatment Step

The R-T-B based sintered magnet material thus obtained as mentioned above is subjected to a second heat treatment by heating to a second heat treatment temperature of 650° C. or higher and 750° C. or lower, and then cooled to 400° C. at a cooling rate of 5° C./min or more. In the embodiment of the present invention, this heat treatment is referred to as a heat treatment step. The R-T-B based sintered magnet material according to the embodiment of the present invention prepared by the above-mentioned step of preparing an R-T-B based sintered magnet material is subjected to the heat treatment step, thus enabling the formation of an R—Ga—Cu phase in the grain boundary between two phases without excessively forming the R-T-Ga phase.

When the second heat treatment temperature is lower than 650° C., a sufficient amount of an R—Ga—Cu phase might not be formed because of too low temperature, and also the R-T-Ga phase formed in the sintering process is not dissolved, causing the R-T-Ga phase to excessively exist after the heat treatment step, thus failing to obtain the high $H_{cJ}$ and high $H_k/H_{cJ}$. When the second heat treatment temperature exceeds 750° C., the R-T-Ga phase is excessively eliminated to thereby form an $R_2T_{17}$ phase, which might reduce $H_{cJ}$ and $H_k/H_{cJ}$. The holding time at the second heating temperature is preferably 5 minutes or more and 500 minutes or less.

After heating to (after holding at) the second heat treatment temperature of 650° C. or higher and 750° C. or lower, when the cooling rate to 400° C. is less than 5° C./min, the $R_2T_{17}$ phase might be excessively formed.

Conventionally, regarding an R-T-B based sintered magnet in which the B content is set lower than that in the standard R-T-B based alloy and Ga or the like is added, if cooling after holding at a heating temperature is not rapid cooling (for example, cooling rate of 40° C./min or more) in the heat treatment step, a large amount of an R-T-Ga phase is formed and an R—Ga—Cu phase is hardly formed, thus failing to have high $H_{cJ}$. However, in the R-T-B based sintered magnet according to the embodiment of the present invention, even if cooling in the heat treatment step is performed at 10° C./min, a sufficient amount of an R—Ga—Cu phase can be formed while suppressing the formation of an R-T-Ga phase, thus making it possible to obtain high $H_{cJ}$ and high $H_k/H_{cJ}$.

That is, the cooling rate from a second heat treatment temperature of 650° C. or higher and 750° C. or lower to a temperature of 400° C. in the second heat treatment according to the embodiment of the present invention may be 5° C./min or more. The cooling rate is preferably 15° C./min or more, and more preferably 50° C./min or more. Such cooling rate enables the formation of a sufficient amount of an R—Ga—Cu phase while further suppressing the formation of an R-T-Ga phase, thus making it possible to obtain higher $H_{cJ}$ and higher $H_k/H_{cJ}$. Cooling may be slow cooling as needed (for example, to prevent the occurrence of cracks due to thermal stress when intended to obtain the larger-sized R-T-B based sintered magnet).

The cooling rate from the heating temperature of 650° C. or higher and 750° C. or lower to 400° C. after heating may be varied while the cooling proceeds from the heating temperature to 400° C. For example, immediately after the start of cooling, the cooling rate may be approximately 15° C./min and may be changed to 5° C./min or the like as the temperature of the magnet material approaches 400° C.

A method of cooling the R-T-B based sintered magnet material from the second heating temperature of 650° C. or higher and 750° C. or lower to the temperature of 400° C. at a cooling rate of 5° C./min or more may involve cooling, for example, by introducing an argon gas into a furnace. However, other arbitrary methods may be employed.

A method for evaluating the cooling rate (5° C./min or more) from the second heat treatment temperature of 650° C. or higher and 750° C. or lower after heating to 400° C. in use may involve evaluating an average cooling rate from the second heat treatment temperature to 400° C. (that is, a value obtained by dividing a temperature difference between the second heat treatment temperature and 400° C. by a time during which the temperature is dropped from the heating temperature to 300° C.).

It is more preferred to perform a low-temperature heat treatment step of heating the R-T-B based sintered magnet after the step 2) (heat treatment step) to a low-temperature heat treatment temperature of 360° C. or higher and 460° C. or lower. It is possible to further improve $H_{cJ}$ by performing the low-temperature heat treatment step. Particularly, an R-T-B based sintered magnet including 1% by mass or more and 10% by mass or less of heavy rare earth elements RH, such as Dy and/or Tb is subjected to the low-temperature heat treatment step, thus enabling an improvement in $H_{cJ}$ drastically. Cooling to room temperature after the low-temperature heat treatment may be performed at an arbitrary cooling rate, and cooling may be either slow cooling (for example, 10° C./min or less) or rapid cooling (for example, 40° C./min or more).

EXAMPLES

The present invention will be described in detail below by way of Examples, but the present invention is not limited thereto.

Example 1: Example in which a Molded Body was Sintered at a Temperature of 1,000° C. or Higher and 1,100° C. or Lower and (Condition a) was Performed and, after Cooling to Room Temperature, a Heat Treatment Step was Performed After weighing raw materials of each element so as to have the composition (composition range of the present invention) shown in Table 1, an alloy was fabricated by a strip casting method. The alloy thus obtained was subjected to hydrogen grinding to obtain a coarse ground powder. Then, 0.04% by mass of a zinc stearate was added as a lubricant and mixed into 100% by mass of the coarse ground powder, followed by dry pulverization under a nitrogen gas flow using a jet mill device to obtain a fine pulverized powder (alloy powder) having a grain size $D_{50}$ of 4 μm. Then, 0.05% by mass of zinc stearate was added as a lubricant and mixed into 100% by mass of the fine pulverized powder, followed by molding under a magnetic field to obtain a molded body. A molding device was a so-called perpendicular magnetic field molding device (transverse magnetic field molding device) in which a magnetic-field application direction is perpendicular to a pressurizing direction. Regarding inequality expressions (1) and (2) in Table 1, the case of satisfying inequality expressions (1) and (2) of the present invention was rated "Good (G)", whereas, the case of not satisfying inequality expressions (1) and (2) of the present invention was rated "Bad (B)" (the same shall apply hereinafter). The thus obtained molded body was subjected to sintering and a heat treatment under the conditions shown in Table 2 to obtain an R-T-B based sintered magnet. As for the specimen No. 1 in Table 2, a molded body was sintered at 1,065° C., followed by temperature dropping from 1,065° C. to 500° C. at an average cooling rate of 3° C./min and further cooling from 500° C. to room temperature (approximately 30° C. to 20° C.) (cooling at an average cooling rate of 10° C./min, the same shall apply to the specimens Nos. 2 to 18) to obtain an R-T-B based sintered magnet material. Furthermore, the thus obtained R-T-B based sintered magnet material was subjected to a heat treatment step of performing a second heat treatment by heating to 700° C., cooled from 700° C. to 400° C. at an average cooling rate of 50° C./min, and then cooled from 400° C. to room temperature (cooling at an average cooling rate of 10° C./min, the same shall apply to the specimens Nos. 2 to 18). As for the specimens Nos. 2 to 18, mention is made in the same way. In all Examples, the sintering time is 4 hours (that is, 4 hours at 1,065° C. in all specimens), and the heating time of the second heat treatment is 3 hours (3 hours at 700° C. in case of the specimen No. 1). The treatment temperature of sintering; the temperature dropping temperature and the temperature dropping rate in (condition a); and the second heat treatment temperature, the cooling temperature, and the cooling rate in heat treatment step, in Table 1 were measured by installing a thermocouple on the molded body or the R-T-B based sintered magnet material. The composition of the thus obtained R-T-B based sintered magnet was measured by high-frequency inductively coupled plasma optical emission spectrometry (ICP-OES). As a result, the composition was identical to that in Table 1.

TABLE 1

| Composition of R—T—B based sintered magnet material (% by mass) | | | | | | | | | Inequality expression | Inequality expression |
|---|---|---|---|---|---|---|---|---|---|---|
| Nd | Pr | Dy | B | Co | Al | Cu | Ga | Fe | (1) | (2) |
| 22.36 | 7.18 | 3.11 | 0.870 | 0.88 | 0.22 | 0.16 | 0.41 | 64.82 | G | G |

TABLE 2

| | | Condition a | | Heat treatment step | | | |
|---|---|---|---|---|---|---|---|
| No. | Sintering Treatment temperature (° C.) | Temperature dropping temperature (° C.) | Temperature dropping rate (° C./min) | Second heat treatment temperature (° C.) | Cooling temperature (° C.) | Cooling rate ° C./min | Remarks |
| No. 1 | 1,065 | 500 | 3 | 700 | 400 | 50 | Example of present invention |
| No. 2 | 1,065 | 500 | 5 | 700 | 400 | 50 | Example of present invention |
| No. 3 | 1,065 | 500 | 10 | 700 | 400 | 50 | Example of present invention |
| No. 4 | 1,065 | 500 | 15 | 700 | 400 | 50 | Comparative Example |
| No. 5 | 1,065 | 500 | 25 | 700 | 400 | 50 | Comparative Example |
| No. 6 | 1,065 | 700 | 3 | 700 | 400 | 50 | Comparative Example |
| No. 7 | 1,065 | 600 | 3 | 700 | 400 | 50 | Comparative Example |
| No. 8 | 1,065 | 500 | 3 | 700 | 400 | 50 | Example of present invention |
| No. 9 | 1,065 | 500 | 3 | 600 | 400 | 50 | Comparative Example |
| No. 10 | 1,065 | 500 | 3 | 640 | 400 | 50 | Comparative Example |

TABLE 2-continued

| No. | Sintering Treatment temperature (° C.) | Condition a: Temperature dropping temperature (° C.) | Condition a: Temperature dropping rate (° C./min) | Heat treatment step: Second heat treatment temperature (° C.) | Heat treatment step: Cooling temperature (° C.) | Heat treatment step: Cooling rate ° C./min | Remarks |
|---|---|---|---|---|---|---|---|
| No. 11 | 1,065 | 500 | 3 | 660 | 400 | 50 | Example of present invention |
| No. 12 | 1,065 | 500 | 3 | 700 | 400 | 50 | Example of present invention |
| No. 13 | 1,065 | 500 | 3 | 740 | 400 | 50 | Example of present invention |
| No. 14 | 1,065 | 500 | 3 | 760 | 400 | 50 | Comparative Example |
| No. 15 | 1,065 | 500 | 3 | 700 | 400 | 1 | Comparative Example |
| No. 16 | 1,065 | 500 | 3 | 700 | 400 | 5 | Example of present invention |
| No. 17 | 1,065 | 500 | 3 | 700 | 400 | 15 | Example of present invention |
| No. 18 | 1,065 | 500 | 3 | 700 | 400 | 50 | Example of present invention |

The R-T-B based sintered magnet thus obtained was machined to fabricate specimens having 7 mm length, 7 mm width, and 7 mm thickness, and then magnetic properties of each specimen was measured by a B—H tracer. The measurement results are shown in Table 3. $H_k/H_{cJ}$ means a value which is obtained by dividing a value of an external magnetic field in which magnetization accounts for 90% of saturation magnetization by ${}_iH_c$ (the same shall apply hereinafter).

TABLE 3

| No. | Magnetic properties: $B_r$ (T) | $H_{cJ}$ (kA/m) | $H_k/H_{cJ}$ | Remarks |
|---|---|---|---|---|
| No. 1 | 1.256 | 1.912 | 0.95 | Example of present invention |
| No. 2 | 1.253 | 1.882 | 0.95 | Example of present invention |
| No. 3 | 1.253 | 1.908 | 0.95 | Example of present invention |
| No. 4 | 1.257 | 1.856 | 0.92 | Comparative Example |
| No. 5 | 1.241 | 1.814 | 0.91 | Comparative Example |
| No. 6 | 1.249 | 1.701 | 0.93 | Comparative Example |
| No. 7 | 1.245 | 1.859 | 0.94 | Comparative Example |
| No. 8 | 1.252 | 1.883 | 0.95 | Example of present invention |
| No. 9 | 1.246 | 1.715 | 0.93 | Comparative Example |
| No. 10 | 1.248 | 1.815 | 0.94 | Comparative Example |
| No. 11 | 1.250 | 1.874 | 0.95 | Example of present invention |
| No. 12 | 1.256 | 1.912 | 0.95 | Example of present invention |
| No. 13 | 1.252 | 1.899 | 0.95 | Example of present invention |
| No. 14 | 1.277 | 1.549 | 0.80 | Comparative Example |
| No. 15 | 1.241 | 1.814 | 0.93 | Comparative Example |
| No. 16 | 1.243 | 1.893 | 0.95 | Example of present invention |
| No. 17 | 1.251 | 1.904 | 0.95 | Example of present invention |
| No. 18 | 1.256 | 1.912 | 0.95 | Example of present invention |

As shown in Table 3, all of Examples of the present invention in which a molded body fabricated so as to have the composition of the present invention were sintered at a temperature of 1,000° C. or higher and 1,100° C. or lower, and then (condition a) was performed to thereby fabricate an R-T-B based sintered magnet material, which was further subjected to a heat treatment step, have high magnetic properties, such as $B_r \geq 1.243$T, $H_{cJ} \geq 1{,}874$ kA/m, and $H_k/H_{cJ} \geq 0.95$. In contrast, all of the specimens Nos. 4 and 5 not satisfying the temperature dropping rate (10° C./min or less) in (condition a), the specimens Nos. 6 and 7 not satisfying the temperature dropping temperature (temperature dropping to 500° C.) in (condition a), the specimens Nos. 9, 10, and 14 not satisfying the second treatment temperature (650° C. or higher and 750° C. or lower) in the heat treatment step, and the specimen No. 15 not satisfying the cooling rate (cooling to 400° C. at 5° C./min or more) in the heat treatment step do not have high magnetic properties, such as $B_r \geq 1.243$T, $H_{cJ} \geq 1{,}874$ kA/m, and $H_k/H_{cJ} \geq 0.95$. In this way, both of (condition a) (or (condition b) mentioned below) and the heat treatment step satisfy the scope of the present invention, whereby, the present invention can have high magnetic properties.

Example 2: Example in which a Molded Body was Sintered at a Temperature of 1,000° C. or Higher and 1,100° C. or Lower and (Condition a) was Performed, and then a Heat Treatment Step was Continuously Performed from a Cooling Temperature of the (Condition a)

An R-T-B based sintered magnet was obtained under the same conditions as in Example 1 (the composition is also the same as in Table 1), except that sintering and the heat treatment were performed under the conditions shown in Table 4. The specimen No. 20 in Table 4 is a specimen obtained by sintering a molded body at 1,065° C., performing temperature dropping from 1,065° C. to 400° C. at an average cooling rate of 3° C./min, and performing a second heat treatment by continuously heating from 400° C. to 700° C. (without cooling to room temperature), followed by cooling from 700° C. to 400° C. at an average cooling rate of 50° C./min and further cooling from 400° C. to room temperature (cooling at an average cooling rate of 10° C./min, the same shall apply to the specimens Nos. 21 to 23). Regarding the specimens Nos. 21 to 23, mention is made in the same way. In all of Examples, the sintering time and the heating time of the second heat treatment are the same as those in Example 1. The composition of the thus obtained R-T-B based sintered magnet was measured by high-frequency inductively coupled plasma optical emission spectrometry (ICP-OES). As a result, the composition was identical to that in Table 1.

TABLE 4

| No. | Sintering Treatment temperature (° C.) | Condition a: Temperature dropping temperature (° C.) | Condition a: Temperature dropping rate (° C./min) | Heat treatment step: Second heat treatment temperature (° C.) | Heat treatment step: Cooling temperature (° C.) | Heat treatment step: Cooling rate ° C./min | Remarks |
|---|---|---|---|---|---|---|---|
| No. 20 | 1,065 | 400 | 3 | 700 | 400 | 50 | Examples of present invention |
| No. 21 | 1,065 | 500 | 3 | 700 | 400 | 50 | Examples of present invention |
| No. 22 | 1,065 | 600 | 3 | 700 | 400 | 50 | Comparative Example |
| No. 23 | 1,065 | 700 | 3 | 700 | 400 | 50 | Comparative Example |

The R-T-B based sintered magnet thus obtained was machined to fabricate specimens having 7 mm length, 7 mm width, and 7 mm thickness, and then magnetic properties of each specimen was measured by a B—H tracer. The measurement results are shown in Table 5.

TABLE 5

| No. | Magnetic properties: $B_r$ (T) | $H_{cJ}$ (kA/m) | $H_k/H_{cJ}$ | Remarks |
|---|---|---|---|---|
| No. 20 | 1.251 | 1.917 | 0.95 | Example of present invention |
| No. 21 | 1.256 | 1.920 | 0.95 | Example of present invention |
| No. 22 | 1.265 | 1.836 | 0.95 | Comparative Example |
| No. 23 | 1.259 | 1.769 | 0.92 | Comparative Example |

As shown in Table 5, when a molded body fabricated so as to have the composition of the present invention was sintered at a temperature of 1,000° C. or higher and 1,100° C. or lower and (condition a) was performed, and then a heat treatment step was continuously performed from a temperature dropping temperature of the (condition a) (the specimens Nos. 20 and 21), it is possible to have high magnetic properties, such as $B_r \geq 1.243$T, $H_{cJ} \geq 1{,}874$ kA/m, and $H_k/H_{cJ} \geq 0.95$, in the same way as in Example 1. In contrast, the specimens Nos. 22 and 23 not satisfying the temperature dropping temperature (temperature dropping to 500° C.) in (condition a) do not have high magnetic properties, such as $B_r \geq 1.243$T, $H_{cJ} \geq 1{,}874$ kA/m, and $H_k/H_{cJ} \geq 0.95$, in the same way as in the specimens Nos. 6 and 7 of Example 1.

Example 3: Example in which a Molded Body was Sintered at a Temperature of 1,000° C. or Higher and 1,100° C. or Lower and (Condition b) was Performed and, after Cooling to Room Temperature, a Heat Treatment Step was Performed An R-T-B based sintered magnet was obtained under the same conditions as in Example 1 (the composition is also the same as in Table 1), except that sintering and the heat treatment were performed under the conditions shown in Table 6. As for the specimen No. 24 in Table 6, an R-T-B based sintered magnet material was fabricated by sintering a molded body at 1,065° C., cooling to room temperature (cooling at an average cooling rate of 10° C./min, the same shall apply to the specimens Nos. 25 to 46) and performing a first heat treatment by heating to 800° C., followed by cooling from 800° C. to 500° C. at an average cooling rate of 3° C./min and further cooling from 500° C. to room temperature (cooling at an average cooling rate of 10° C./min, the same shall apply to the specimens Nos. 25 to 46). The thus obtained R-T-B based sintered magnet material was further subjected to a heat treatment step, that is, a second heat treatment by heating to 700° C., followed by cooling from 700° C. to 400° C. at an average cooling rate of 50° C./min and further cooling from 400° C. to room temperature (cooling at an average cooling rate of 10° C./min, the same shall apply to the specimens Nos. 25 to 46). Regarding the specimens Nos. 25 to 46, mention is made in the same way. The sintering time of all specimens is 4 hours, and each heating time of the first heat treatment and the second heat treatment is 3 hours. The treatment temperature of sintering; the first heat treatment temperature, the temperature dropping temperature, and the temperature dropping rate in (condition b); and the second heat treatment temperature, the cooling temperature, and the cooling rate in the heat treatment step, in Table 6 were measured by installing a thermocouple on the molded body and the R-T-B based sintered magnet material. The composition of the thus obtained R-T-B based sintered magnet was measured by high-frequency inductively coupled plasma optical emission spectrometry (ICP-OES). As a result, the composition was identical to that in Table 1.

TABLE 6

| No. | Sintering Treatment temperature (° C.) | Condition b: First heat treatment temperature (° C.) | Condition b: Temperature dropping temperature (° C.) | Condition b: Temperature dropping rate (° C./min) | Heat treatment step: Second heat treatment temperature (° C.) | Heat treatment step: Cooling temperature (° C.) | Heat treatment step: Cooling rate ° C./min | Remarks |
|---|---|---|---|---|---|---|---|---|
| No. 24 | 1,065 | 800 | 500 | 3 | 700 | 400 | 50 | Example of present invention |
| No. 25 | 1,065 | 800 | 500 | 5 | 700 | 400 | 50 | Example of present invention |

TABLE 6-continued

| No. | Sintering Treatment temperature (° C.) | Condition b: First heat treatment temperature (° C.) | Condition b: Temperature dropping temperature (° C.) | Condition b: Temperature dropping rate (° C./min) | Heat treatment step: Second heat treatment temperature (° C.) | Heat treatment step: Cooling temperature (° C.) | Heat treatment step: Cooling rate ° C./min | Remarks |
|---|---|---|---|---|---|---|---|---|
| No. 26 | 1,065 | 800 | 500 | 10 | 700 | 400 | 50 | Example of present invention |
| No. 27 | 1,065 | 800 | 500 | 15 | 700 | 400 | 50 | Comparative Example |
| No. 28 | 1,065 | 800 | 500 | 25 | 700 | 400 | 50 | Comparative Example |
| No. 29 | 1.065 | 800 | 700 | 3 | 700 | 400 | 50 | Comparative Example |
| No. 30 | 1,065 | 800 | 600 | 3 | 700 | 400 | 50 | Comparative Example |
| No. 31 | 1,065 | 800 | 500 | 3 | 700 | 400 | 50 | Example of present invention |
| No. 32 | 1,065 | 800 | 500 | 3 | 600 | 400 | 50 | Comparative Example |
| No. 33 | 1,065 | 800 | 500 | 3 | 640 | 400 | 50 | Comparative Example |
| No. 34 | 1,065 | 800 | 500 | 3 | 660 | 400 | 50 | Example of present invention |
| No. 35 | 1,065 | 800 | 500 | 3 | 700 | 400 | 50 | Example of present invention |
| No. 36 | 1,065 | 800 | 500 | 3 | 740 | 400 | 50 | Example of present invention |
| No. 37 | 1,065 | 800 | 500 | 3 | 760 | 400 | 50 | Comparative Example |
| No. 38 | 1.065 | 800 | 500 | 3 | 700 | 400 | 1 | Comparative Example |
| No. 39 | 1,065 | 800 | 500 | 3 | 700 | 400 | 5 | Example of present invention |
| No. 40 | 1,065 | 800 | 500 | 3 | 700 | 400 | 15 | Example of present invention |
| No. 41 | 1,065 | 800 | 500 | 3 | 700 | 400 | 50 | Example of present invention |
| No. 42 | 1,065 | 750 | 500 | 3 | 700 | 400 | 50 | Comparative Example |
| No. 43 | 1,065 | 800 | 500 | 3 | 700 | 400 | 50 | Example of present invention |
| No. 44 | 1,065 | 900 | 500 | 3 | 700 | 400 | 50 | Example of present invention |
| No. 45 | 1,065 | 950 | 500 | 3 | 700 | 400 | 50 | Example of present invention |
| No. 46 | 1,065 | 1,000 | 500 | 3 | 700 | 400 | 50 | Comparative Example |

The R-T-B based sintered magnet thus obtained was machined to fabricate specimens having 7 mm length, 7 mm width, and 7 mm thickness, and then magnetic properties of each specimen was measured by a B—H tracer. The measurement results are shown in Table 7.

TABLE 7

| No. | Magnetic properties: $B_r$ (T) | $H_{cJ}$ (kA/m) | $H_k/H_{cJ}$ | Remarks |
|---|---|---|---|---|
| No. 24 | 1.258 | 1.911 | 0.95 | Example of present invention |
| No. 25 | 1.234 | 1.906 | 0.95 | Example of present invention |
| No. 26 | 1.232 | 1.877 | 0.95 | Example of present invention |
| No. 27 | 1.242 | 1.820 | 0.91 | Comparative Example |
| No. 28 | 1.255 | 1.804 | 0.90 | Comparative Example |
| No. 29 | 1.245 | 1.659 | 0.93 | Comparative Example |
| No. 30 | 1.249 | 1.823 | 0.93 | Comparative Example |
| No. 31 | 1.253 | 1.908 | 0.95 | Example of present invention |
| No. 32 | 1.241 | 1.739 | 0.90 | Comparative Example |
| No. 33 | 1.258 | 1.805 | 0.92 | Comparative Example |
| No. 34 | 1.244 | 1.881 | 0.95 | Example of present invention |
| No. 35 | 1.258 | 1.911 | 0.95 | Example of present invention |
| No. 36 | 1.262 | 1.901 | 0.95 | Example of present invention |
| No. 37 | 1.241 | 1.594 | 0.86 | Comparative Example |
| No. 38 | 1.257 | 1.796 | 0.93 | Comparative Example |
| No. 39 | 1.255 | 1.876 | 0.95 | Example of present invention |
| No. 40 | 1.248 | 1.928 | 0.94 | Example of present invention |
| No. 41 | 1.258 | 1.911 | 0.95 | Example of present invention |
| No. 42 | 1.244 | 1.787 | 0.91 | Comparative Example |
| No. 43 | 1.258 | 1.911 | 0.95 | Example of present invention |
| No. 44 | 1.241 | 1.887 | 0.95 | Example of present invention |

TABLE 7-continued

| No. | Magnetic properties: $B_r$ (T) | $H_{cJ}$ (kA/m) | $H_k/H_{cJ}$ | Remarks |
|---|---|---|---|---|
| No. 45 | 1.248 | 1.878 | 0.95 | Example of present invention |
| No. 46 | 1.245 | 1.771 | 0.85 | Comparative Example |

As shown in Table 7, all of Examples of the present invention in which a molded body fabricated so as to have the composition of the present invention were sintered at a temperature of 1,000° C. or higher and 1,100° C. or lower, and then (condition b) was performed to thereby fabricate an R-T-B based sintered magnet material, which was further subjected to a heat treatment step, have high magnetic properties, such as $B_r \geq 1.232$T, $H_{cJ} \geq 1{,}876$ kA/m, and $H_k/H_{cJ} \geq 0.94$. In contrast, all of the specimens Nos. 42 and 46 not satisfying the first heat treatment temperature (800° C. or higher and 950° C. or lower) in (condition b), the specimens Nos. 27 and 28 not satisfying the temperature dropping rate (10° C./min or less) in (condition b), the specimens Nos. 29 and 30 not satisfying the temperature dropping temperature (temperature dropping to 500° C.) in (condition b), the specimens Nos. 32, 33, and 37 not satisfying the second treatment temperature (650° C. or higher and 750° C. or lower) in the heat treatment step, and the specimen Nos. 38 not satisfying the cooling rate (cooling to 400° C. at 5° C./min or more) in the heat treatment step do not have high magnetic properties, such as $B_r \geq 1.232$T, $H_{cJ} \geq 1{,}876$ kA/m, and $H_k/H_{cJ} \geq 0.94$. In this way, both of (condition a) or (condition b) mentioned above and the heat treatment step satisfy the scope of the present invention, whereby, the present invention can have high magnetic properties.

Example 4: Example in which a Molded Body is Sintered at a Temperature of 1,000° C. or Higher and 1,100° C. or Lower and Performing (Condition b), and then a Heat Treatment Step was Continuously Performed from a Temperature Dropping Temperature of the (Condition b)

An R-T-B based sintered magnet was obtained under the same conditions as in Example 3, except that sintering and the heat treatment were performed under the conditions shown in Table 8. As for the specimen No. 48 in Table 8, a molded body was sintered at 1,065° C., cooled to room temperature (cooling at an average cooling rate of 10° C./min, the same shall apply to the specimens Nos. 49 to 51), and then subjected to a first heat treatment by heating from room temperature to 800° C., followed by cooling from 800° C. to 400° C. at an average cooling rate of 3° C./min. Furthermore, the sintered molded body was subjected to a second heat treatment by heating to 700° (without cooling to room temperature), followed by cooling from 700° C. to 400° C. at an average cooling rate of 50° C./min and further cooling from 400° C. to room temperature (cooling at an average cooling rate of 10° C./min, the same shall apply to the specimens Nos. 49 to 51). Regarding the specimens Nos. 49 to 51, mention is made in the same way. In all Examples, the sintering time, the first heat treatment, and the heating time of the second heat treatment are the same as those in Example 3. The composition of the thus obtained R-T-B based sintered magnet was measured by high-frequency inductively coupled plasma optical emission spectrometry (ICP-OES). As a result, the composition was identical to that in Table 1.

TABLE 8

| | | Condition b | | | Heat treatment step | | | |
|---|---|---|---|---|---|---|---|---|
| No. | Sintering Treatment temperature (° C.) | First heat treatment temperature (° C.) | Temperature dropping temperature (° C.) | Temperature dropping rate (° C./min) | Second heat treatment temperature (° C.) | Cooling temperature (° C.) | Cooling rate ° C./min | Remarks |
| No. 48 | 1,065 | 800 | 400 | 3 | 700 | 400 | 50 | Example of present invention |
| No. 49 | 1,065 | 800 | 500 | 3 | 700 | 400 | 50 | Example of present invention |
| No. 50 | 1,065 | 800 | 600 | 3 | 700 | 400 | 50 | Comparative Example |
| No. 51 | 1,065 | 800 | 700 | 3 | 700 | 400 | 50 | Comparative Example |

The R-T-B based sintered magnet thus obtained was machined to fabricate specimens having 7 mm length, 7 mm width, and 7 mm thickness, and then magnetic properties of each specimen was measured by a B—H tracer. The measurement results are shown in Table 9.

TABLE 9

| | Magnetic properties | | | |
|---|---|---|---|---|
| No. | $B_r$ (T) | $H_{cJ}$ (ka/m) | $H_k/H_{cJ}$) | Remarks |
| No. 48 | 1.261 | 1.908 | 0.95 | Example of present invention |
| No. 49 | 1.261 | 1.903 | 0.95 | Example of present invention |

TABLE 9-continued

| | Magnetic properties | | | |
|---|---|---|---|---|
| No. | $B_r$ (T) | $H_{cJ}$ (ka/m) | $H_k/H_{cJ}$) | Remarks |
| No. 50 | 1.257 | 1.866 | 0.95 | Comparative Example |
| No. 51 | 1.265 | 1.540 | 0.92 | Comparative Example |

As shown in Table 9, when a molded body fabricated so as to have the composition of the present invention was sintered at a temperature of 1,000° C. or higher and 1,100° C. or lower and (condition b) was performed, and then a heat treatment step was continuously performed from a temperature dropping temperature of the (condition b) (the specimens Nos. 48 and 49), it is possible to have high magnetic properties, such as $B_r \geq 1.232T$, $H_{cJ} \geq 1{,}876$ kA/m, and $H_k/H_{cJ} \geq 0.94$, in the same way as in Example 3. In contrast, the specimens Nos. 50 and 51 not satisfying the temperature dropping temperature (temperature dropping to 500° C.) in (condition b) do not have high magnetic properties, such as $B_r \geq 1.232T$, $H_{cJ} \geq 1{,}876$ kA/m, and $H_k/H_{cJ} \geq 0.94$, in the same way as in the specimens Nos. 29 and 30 of Example 3.

Example 5: Example in which the Composition Range is Limited

Two molded bodies each were fabricated under the same conditions as in Example 1, except that raw materials of each element were weighed so as to have the composition in Table 10. Of the thus obtained two molded bodies, one molded article was subjected to sintering and the heat treatment of No. α ((condition a) and heat treatment step of the present invention) in Table 11 to obtain an R-T-B based sintered magnet, while the other one was subjected to sintering and the heat treatment of No. β ((condition b) and heat treatment step of the present invention) in Table 11 to obtain an R-T-B based sintered magnet. In No. α, sintering and the heat treatment were performed under the same conditions as in the specimen No. 1. In No. β, sintering and the heat treatment were performed under the same conditions as in the specimen No. 24, except that a molded body was sintered at 1,065° C., cooled from 1,065° C. to 800° C. (cooling at an average cooling rate of 20° C./min) and then continuously subjected to a first heat treatment at 800° C. The R-T-B based sintered magnet thus obtained was machined to fabricate specimens having 7 mm length, 7 mm width, and 7 mm thickness, and then magnetic properties of each specimen was measured by a B—H tracer. The measurement results are shown in Table 12. As for the specimen No. 52 in Table 12, an R-T-B based sintered magnet is obtained by subjecting a molded body No. A-1 in Table 10 to sintering and the heat treatment in accordance with No. α in Table 11. Regarding the specimens Nos. 53 to 99, mention is made in the same way. In all specimens, the sintering time is 4 hours, and each heating time of the first heat treatment and the second heat treatment is 3 hours. The treatment temperature of sintering; the first heat treatment temperature, the temperature dropping temperature, and the temperature dropping rate in (condition a) or (condition b); and the second heat treatment temperature, the cooling temperature, and the cooling rate in the heat treatment step, mentioned above, were measured by installing a thermocouple on the molded body and the R-T-B based sintered magnet material. The composition of the thus obtained R-T-B based sintered magnet was measured by high-frequency inductively coupled plasma optical emission spectrometry (ICP-OES). As a result, the composition was identical to that in Table 10.

TABLE 10

| Molded | Composition of R—T—B based sintered magnet (% by mass) | | | | | | | | | Inequality expression | Inequality expression |
|---|---|---|---|---|---|---|---|---|---|---|---|
| body No. | Nd | Pr | Dy | B | Co | Al | Cu | Ga | Fe | (1) | (2) |
| No. A-1 | 22.20 | 7.17 | 3.03 | 0.95 | 0.87 | 0.21 | 0.15 | 0.39 | 65.04 | B | G |
| No. A-2 | 22.38 | 7.20 | 3.02 | 0.84 | 0.86 | 0.21 | 0.15 | 0.59 | 64.69 | G | G |
| No. A-3 | 22.25 | 7.10 | 3.08 | 0.92 | 0.88 | 0.22 | 0.15 | 0.38 | 65.03 | B | G |
| No. A-4 | 22.25 | 7.20 | 3.02 | 0.89 | 0.86 | 0.21 | 0.15 | 0.19 | 65.23 | G | G |
| No. A-5 | 22.30 | 7.23 | 3.01 | 0.87 | 0.86 | 0.21 | 0.15 | 0.20 | 65.18 | G | B |
| No. A-6 | 22.36 | 7.18 | 3.11 | 0.87 | 0.88 | 0.22 | 0.16 | 0.41 | 64.82 | G | G |
| No. A-7 | 22.32 | 7.24 | 3.02 | 0.89 | 0.86 | 0.21 | 0.15 | 0.72 | 64.58 | G | G |
| No. A-8 | 22.33 | 7.15 | 3.10 | 0.91 | 0.88 | 0.22 | 0.03 | 0.40 | 64.99 | G | G |
| No. B-1 | 23.40 | 7.52 | 1.02 | 0.94 | 0.86 | 0.24 | 0.15 | 0.36 | 65.51 | B | G |
| No. B-2 | 23.43 | 7.53 | 1.02 | 0.84 | 0.86 | 0.24 | 0.14 | 0.51 | 65.44 | G | B |
| No. B-3 | 23.45 | 7.55 | 1.02 | 0.92 | 0.86 | 0.22 | 0.15 | 0.36 | 65.47 | B | G |
| No. B-4 | 23.48 | 7.56 | 1.02 | 0.90 | 0.86 | 0.24 | 0.17 | 0.19 | 65.59 | G | G |
| No. B-5 | 23.50 | 7.57 | 1.02 | 0.88 | 0.86 | 0.24 | 0.15 | 0.22 | 65.57 | G | B |
| No. B-6 | 23.53 | 7.58 | 1.02 | 0.88 | 0.86 | 0.23 | 0.14 | 0.37 | 65.40 | G | G |
| No. B-7 | 23.55 | 7.60 | 1.02 | 0.89 | 0.86 | 0.24 | 0.15 | 0.71 | 64.99 | G | G |
| No. B-8 | 23.44 | 7.57 | 1.01 | 0.90 | 0.86 | 0.20 | 0.03 | 0.37 | 65.63 | G | G |
| No. C-1 | 20.60 | 6.66 | 4.99 | 0.94 | 0.86 | 0.22 | 0.14 | 0.36 | 65.23 | B | G |
| No. C-2 | 20.70 | 6.72 | 5.04 | 0.84 | 0.86 | 0.21 | 0.14 | 0.47 | 65.03 | G | B |
| No. C-3 | 20.65 | 6.69 | 5.02 | 0.92 | 0.86 | 0.22 | 0.14 | 0.36 | 65.15 | B | G |
| No. C-4 | 20.63 | 6.68 | 5.01 | 0.91 | 0.86 | 0.22 | 0.14 | 0.18 | 65.38 | G | G |
| No. C-5 | 20.67 | 6.70 | 5.02 | 0.88 | 0.86 | 0.21 | 0.14 | 0.20 | 65.32 | G | B |
| No. C-6 | 20.70 | 7.05 | 4.97 | 0.88 | 0.88 | 0.21 | 0.16 | 0.37 | 64.78 | G | G |
| No. C-7 | 20.68 | 6.71 | 5.03 | 0.88 | 0.86 | 0.21 | 0.14 | 0.73 | 64.75 | G | G |
| No. C-8 | 20.62 | 6.67 | 5.00 | 0.89 | 0.86 | 0.22 | 0.04 | 0.36 | 65.35 | G | G |

TABLE 11

| | | Condition a or b | | | Heat treatment step | | |
|---|---|---|---|---|---|---|---|
| No. | Sintering Treatment temperature (° C.) | First heat treatment temperature (° C.) | Temperature dropping temperature (° C.) | Temperature dropping rate (° C./min) | Second heat treatment temperature (° C.) | Cooling temperature (° C.) | Cooling rate ° C./min |
| α | 1,065 | — | 500 | 3 | 700 | 400 | 50 |
| β | 1,065 | 800 | 500 | 3 | 700 | 400 | 50 |

TABLE 12

| | | | Magnetic properties | | | |
|---|---|---|---|---|---|---|
| No. | Molded body No. | Condition | $B_r$ (T) | $H_{cJ}$ (ka/m) | $H_k/H_{cJ}$ | Remarks |
| No. 52 | No. A-1 | α | 1.302 | 1,343 | 0.84 | Comparative Example |
| No. 53 | No. A-2 | α | 1.248 | 1,758 | 0.87 | Comparative Example |
| No. 54 | No. A-3 | α | 1.282 | 1,410 | 0.81 | Comparative Example |
| No. 55 | No. A-4 | α | 1.277 | 1,770 | 0.92 | Comparative Example |
| No. 56 | No. A-5 | α | 1.267 | 1,748 | 0.90 | Comparative Example |
| No. 57 | No. A-6 | α | 1.256 | 1,912 | 0.95 | Example |
| No. 58 | No. A-7 | α | 1.230 | 1,841 | 0.84 | Comparative Example |
| No. 59 | No. A-8 | α | 1.218 | 1,581 | 0.92 | Comparative Example |
| No. 60 | No. A-1 | β | 1.290 | 1,333 | 0.90 | Comparative Example |
| No. 61 | No. A-2 | β | 1.251 | 1,677 | 0.91 | Comparative Example |
| No. 62 | No. A-3 | β | 1.284 | 1,319 | 0.86 | Comparative Example |
| No. 63 | No. A-4 | β | 1.267 | 1,748 | 0.90 | Comparative Example |
| No. 64 | No. A-5 | β | 1.279 | 1,733 | 0.91 | Comparative Example |

TABLE 12-continued

| No. | Molded body No. | Condition | Magnetic properties $B_r$ (T) | $H_{cJ}$ (ka/m) | $H_k/H_{cJ}$ | Remarks |
|---|---|---|---|---|---|---|
| No. 65 | No. A-6 | β | 1.258 | 1,911 | 0.95 | Example |
| No. 66 | No. A-7 | β | 1.232 | 1,843 | 0.83 | Comparative Example |
| No. 67 | No. A-8 | β | 1.216 | 1,445 | 0.90 | Comparative Example |
| No. 68 | No. B-1 | α | 1.339 | 1,004 | 0.86 | Comparative Example |
| No. 69 | No. B-2 | α | 1.277 | 1,372 | 0.81 | Comparative Example |
| No. 70 | No. B-3 | α | 1.334 | 989 | 0.88 | Comparative Example |
| No. 71 | No. B-4 | α | 1.329 | 1,328 | 0.89 | Comparative Example |
| No. 72 | No. B-5 | α | 1.329 | 1,346 | 0.89 | Comparative Example |
| No. 73 | No. B-6 | α | 1.322 | 1,482 | 0.95 | Example |
| No. 74 | No. B-7 | α | 1.295 | 1,372 | 0.87 | Comparative Example |
| No. 75 | No. B-8 | α | 1.271 | 1,192 | 0.91 | Comparative Example |
| No. 76 | No. B-1 | β | 1.340 | 1,017 | 0.86 | Comparative Example |
| No. 77 | No. B-2 | β | 1.280 | 1,344 | 0.81 | Comparative Example |
| No. 78 | No. B-3 | β | 1.341 | 1,005 | 0.87 | Comparative Example |
| No. 79 | No. B-4 | β | 1.338 | 1,339 | 0.90 | Comparative Example |
| No. 80 | No. B-5 | β | 1.339 | 1,334 | 0.84 | Comparative Example |
| No. 81 | No. B-6 | β | 1.321 | 1,495 | 0.94 | Example |
| No. 82 | No. B-7 | β | 1.292 | 1,379 | 0.84 | Comparative Example |
| No. 83 | No. B-8 | β | 1.283 | 1,218 | 0.92 | Comparative Example |
| No. 84 | No. C-1 | α | 1.246 | 1,631 | 0.83 | Comparative Example |
| No. 85 | No. C-2 | α | 1.205 | 2,032 | 0.75 | Comparative Example |
| No. 86 | No. C-3 | α | 1.249 | 1,611 | 0.86 | Comparative Example |
| No. 87 | No. C-4 | α | 1.241 | 1,967 | 0.89 | Comparative Example |
| No. 88 | No. C-5 | α | 1.222 | 1,950 | 0.85 | Comparative Example |
| No. 89 | No. C-6 | α | 1.227 | 2,194 | 0.95 | Example |
| No. 90 | No. C-7 | α | 1.201 | 2,142 | 0.85 | Comparative Example |
| No. 91 | No. C-8 | α | 1.197 | 1,631 | 0.91 | Comparative Example |
| No. 92 | No. C-1 | β | 1.249 | 1,595 | 0.85 | Comparative Example |
| No. 93 | No. C-2 | β | 1.210 | 1,977 | 0.89 | Comparative Example |
| No. 94 | No. C-3 | β | 1.237 | 1,684 | 0.92 | Comparative Example |
| No. 95 | No. C-4 | β | 1.243 | 2,015 | 0.88 | Comparative Example |
| No. 96 | No. C-5 | β | 1.214 | 1,999 | 0.89 | Comparative Example |
| No. 97 | No. C-6 | β | 1.226 | 2,187 | 0.95 | Example |
| No. 98 | No. C-7 | β | 1.199 | 2,111 | 0.86 | Comparative Example |
| No. 99 | No. C-8 | β | 1.195 | 1,651 | 0.90 | Comparative Example |

As shown in Table 12, when comparing the specimens Nos. 52 to 67 each having almost the same Dy content (approximately 3% by mass), the specimens of the present invention (the specimens Nos. 57 and 65) have high magnetic properties, such as $B_r \geq 1.256T$, $H_{cJ} \geq 1$ 911 kA/m, and $H_k/H_{cJ} \geq 0.95$. In contrast, all of the specimens of Comparative Examples deviating from the composition range of the present invention (the B content and the inequality expression (1) of the specimens Nos. 52 and 60 deviate from the scope of the present invention, the B content of the specimens Nos. 53 and 61 deviates from the scope of the present invention, the inequality expression (1) of the specimens Nos. 54 and 62 deviates from the scope of the present invention, Ga of the specimens Nos. 55, 58, 63, and 66 deviates from the scope of the present invention, the inequality expression (2) of the specimens Nos. 56 and 64 deviates from the scope of the present invention, and Cu of the specimens Nos. 59 and 67 deviates from the scope of the present invention) do not have high magnetic properties, such as $B_r \geq 1.256T$, $H_{cJ} \geq 1{,}911$ kA/m, and $H_k/H_{cJ} \geq 0.95$. Likewise, as for the specimens Nos. 68 to 83 each having the Dy content of approximately 1% by mass, and the specimens Nos. 84 to 99 each having the Dy content of approximately 5% by mass, the specimens of the present invention have high magnetic properties as compared with the specimens of Comparative Examples. In this way, even when both of (condition a) or (condition b) and the heat treatment step satisfy the scope of the present invention, it is impossible to have high magnetic properties unless the composition falls within a composition range of the present invention.

Example 6: Photograph of Structure

Each R-T-B based sintered magnet of the specimen No. 1 (Example of the present invention) and the specimen No. 5 (Comparative Example) was cut by a cross section polisher (device name: SM-09010, manufactured by JEOL, Ltd.) and reflected electron images of the thus obtained cross section were taken at a magnification of 2,000 times using FE-SEM (device name: JSM-7001F, manufactured by JEOL, Ltd.). The reflected electron images are shown in FIG. 1 (specimen No. 1) and FIG. 2 (specimen No. 5). With respect to analytical positions 1 and 2 of FIG. 2, composition analysis was performed by EDX (device name: JED-2300, manufactured by JEOL, Ltd.) attached to FE-SEM. The results are shown in Table 13. The measurement was made excluding B because of poor quantitativity of a light element in EDX.

TABLE 13

(Atomic %)

| Analytical position | Fe | Nd | Pr | Dy | Co | Cu | Ga | Al | Si |
|---|---|---|---|---|---|---|---|---|---|
| 1 | 67.3 | 19.2 | 6.2 | 6.7 | 0.4 | — | — | 0.2 | 0.1 |
| 2 | 71.5 | 17.2 | 5.5 | 4.9 | 0.7 | — | — | 0.2 | 0.1 |

Figure 2:
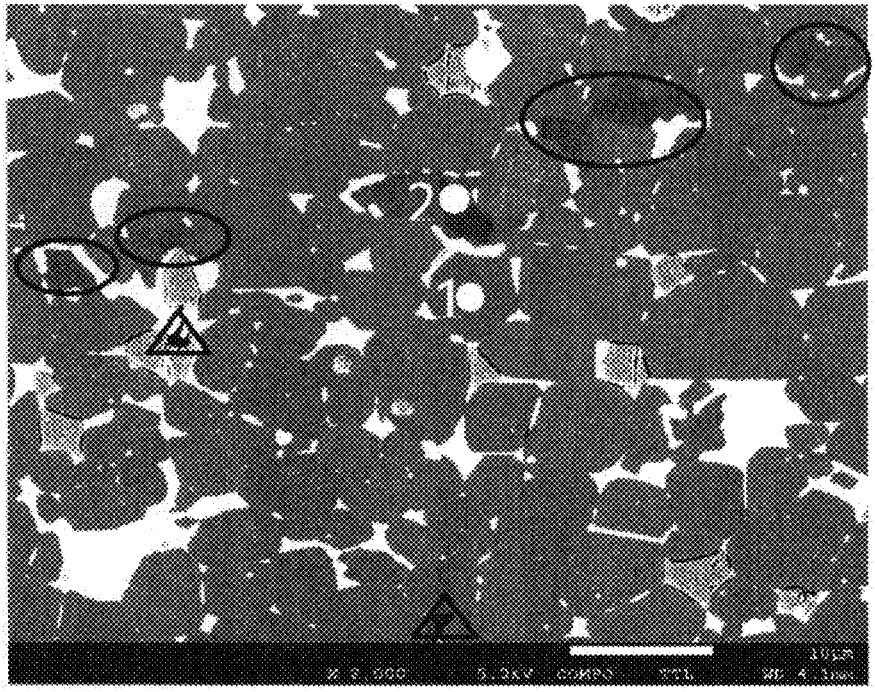
FIG. 2 is a photograph of a reflected electron image taken by FE-SEM of a specimen No. 5.

As shown in FIG. 2 and Table 13, an $R_2T_{14}B$ phase as a main phase exists at the analytical position 1 (corresponds to a white circle indicated by the symbol 1 in FIG. 2), and an $R_2T_{17}$ phase having the Fe concentration higher than that of the main phase exists at the analytical position 2 (corresponds to a white circle indicated by the symbol 2 in FIG. 2) which has dark (pale black) contrast as compared with the $R_2T_{14}B$ phase (gray). A deep black part (for example, the part surrounded with a triangle in FIG. 2) observed in both FIGS. 1 and 2 shows a recess formed during cutting. As is apparent from FIG. 1 and FIG. 2, an $R_2T_{17}$ phase remains at a plurality of positions (for example, the part surrounded with a circle) in FIG. 2 (the specimen No. 5 as Comparative Example), whereas, no $R_2T_{17}$ phase was observed in FIG. 1 (the specimen No. 1 as Example of the present invention).

Example 7: Example Subjected to a Low-Temperature Heat Treatment Step

A plurality of molded bodies were fabricated under the same conditions as in Example 1, except that raw materials of each element were weighed so as to have the composition in Table 14. An R-T-B based sintered magnet was obtained by performing the conditions shown in Table 15 of the molded body thus obtained. The R-T-B based sintered magnet thus obtained was machined to fabricate specimens having 7 mm length, 7 mm width, and 7 mm thickness, and then magnetic properties of each specimen was measured by a B—H tracer. The measurement results are shown in Table 16. As for the specimen No. 100 in Table 16, an R-T-B based sintered magnet was obtained by subjecting a molded body No. D-1 shown in Table 14 to sintering, the first heat treatment, the second heat treatment, and the low-temperature heat treatment under the condition No. a in Table 15 (low-temperature heat treatment is omitted in case of the condition No. a). Regarding the specimens Nos. 101 to 118, mention is made in the same way. In all specimens, the sintering time is 4 hours, and each heating time of the first heat treatment, the second heat treatment, and the low-temperature heat treatment is 3 hours. The treatment temperature of sintering; the first heat treatment temperature, the temperature dropping temperature, and the temperature dropping rate; the second heat treatment temperature, the cooling temperature, and the cooling rate in the heat treatment step; and the low-temperature heat treatment temperature in the low-temperature heat treatment step, mentioned above, were measured by installing a thermocouple on the molded body, the R-T-B based sintered magnet material, and the R-T-B based sintered magnet. The composition of the R-T-B based sintered magnet after the low-temperature heat treatment step was measured by high-frequency inductively coupled plasma optical emission spectrometry (ICP-OES). As a result, the composition was identical to that in Table 16.

TABLE 14

| Molded | Composition of R—T—B based sintered magnet (% by mass) | | | | | | | | | Inequality expression | Inequality expression |
|---|---|---|---|---|---|---|---|---|---|---|---|
| body No. | Nd | Pr | Dy | B | Co | Al | Cu | Ga | Fe | (1) | (2) |
| No. D-1 | 24.18 | 7.89 | 0.01 | 0.874 | 0.88 | 0.22 | 0.16 | 0.38 | 65.41 | G | G |
| No. E-1 | 22.36 | 7.18 | 3.11 | 0.870 | 0.88 | 0.22 | 0.16 | 0.41 | 64.82 | G | G |
| No. F-1 | 20.70 | 7.05 | 4.97 | 0.88 | 0.88 | 0.21 | 0.16 | 0.37 | 64.78 | G | G |

TABLE 15

| | | Condition a or b | | | Heat treatment step | | | Low-temperature heat treatment step |
|---|---|---|---|---|---|---|---|---|
| No. | Sintering Treatment temperature (° C.) | First heat treatment temperature (° C.) | Temperature dropping temperature (° C.) | Temperature dropping rate (° C./min) | Second heat treatment temperature (° C.) | Cooling temperature (° C.) | Cooling rate ° C./min | Low-temperature heat treatment temperature (° C.) |
| a | 1,065 | 800 | 500 | 3 | 700 | 400 | 50 | None |
| b | 1,065 | 800 | 500 | 3 | 700 | 400 | 50 | 350 |
| c | 1,065 | 800 | 500 | 3 | 700 | 400 | 50 | 390 |
| d | 1,065 | 800 | 500 | 3 | 700 | 400 | 50 | 410 |
| e | 1,065 | 800 | 500 | 3 | 700 | 400 | 50 | 430 |
| f | 1,065 | 800 | 500 | 3 | 700 | 400 | 50 | 450 |
| g | 1,065 | 800 | 500 | 3 | 700 | 400 | 50 | 470 |
| h | 1,065 | 800 | 500 | 3 | 700 | 400 | 50 | 490 |
| i | 1,065 | 800 | 500 | 3 | 700 | 400 | 50 | 370 |
| j | 1,065 | 800 | 500 | 3 | 700 | 400 | 50 | 400 |

TABLE 16

| | Molded | | Magnetic properties | | |
|---|---|---|---|---|---|
| No. | body No. | Condition | $B_r$ (T) | $H_{cJ}$ (kA/m) | $H_k/H_{cJ}$) |
| No. 100 | No. D-1 | a | 1.316 | 1.337 | 0.973 |
| No. 101 | No. D-1 | b | 1.320 | 1.330 | 0.982 |
| No. 102 | No. D-1 | c | 1.318 | 1.378 | 0.973 |
| No. 103 | No. D-1 | d | 1.320 | 1.373 | 0.972 |
| No. 104 | No. D-1 | e | 1.322 | 1.382 | 0.975 |
| No. 105 | No. D-1 | f | 1.315 | 1.387 | 0.977 |
| No. 106 | No. D-1 | g | 1.308 | 1.303 | 0.980 |
| No. 107 | No. D-1 | h | 1.308 | 1.219 | 0.970 |
| No. 108 | No. E-1 | a | 1.255 | 1.914 | 0.951 |
| No. 109 | No. E-1 | b | 1.252 | 1.907 | 0.950 |
| No. 110 | No. E-1 | i | 1.248 | 1.948 | 0.951 |
| No. 111 | No. E-1 | d | 1.255 | 1.975 | 0.950 |
| No. 112 | No. E-1 | e | 1.254 | 2.003 | 0.950 |
| No. 113 | No. E-1 | f | 1.252 | 1.983 | 0.950 |

TABLE 16-continued

| No. | Molded body No. | Condition | Magnetic properties $B_r$ (T) | $H_{cJ}$ (kA/m) | $H_k/H_{cJ}$) |
|---|---|---|---|---|---|
| No. 114 | No. E-1 | h | 1.264 | 1.871 | 0.942 |
| No. 115 | No. F-1 | a | 1.226 | 2.187 | 0.950 |
| No. 116 | No. F-1 | b | 1.225 | 2.200 | 0.951 |
| No. 117 | No. F-1 | j | 1.214 | 2.287 | 0.950 |
| No. 118 | No. F-1 | f | 1.213 | 2.317 | 0.951 |

As shown in Table 16, in a comparison among the specimens Nos. 100 to 107 each having the same Dy content (0.01% by mass), the specimens Nos. 102 to 105, which are obtained by subjecting to a low-temperature heat treatment step at a low-temperature heat treatment temperature (360 to 460° C.) of the present invention, achieved high $H_{cJ}$ as compared with the specimen No. 100 which is not subjected to the low-temperature heat treatment, and the specimens Nos. 101, 106, and 107 which deviate from the low-temperature heat treatment temperature of the present invention. Likewise, as for the specimens Nos. 108 to 114 in which the Dy content is approximately 3% by mass and the specimens Nos. 115 to 118 in which the Dy content is approximately 5% by mass, high $H_{cJ}$ is achieved by performing the low-temperature heat treatment step. When the Dy content is 1% by mass or more, $H_{cJ}$ is extremely enhanced to approximately 90 to 100 kA/m by performing the low-temperature heat treatment step as compared with the case where the low-temperature heat treatment step is not performed (comparing the specimen No. 108 with the specimen No. 112, and comparing the specimen No. 115 with the specimen No. 117).

The present application claims priority to Japanese Patent Application No. 2015-251677 filed on Dec. 24, 2015 and Japanese Patent Application No. 2016-036272 filed on Feb. 26, 2016, the disclosure of which is incorporated herein by reference in its entirety.

The invention claimed is:

1. A method for manufacturing an R-T-B based sintered magnet, which comprises:

1) a step of preparing an R-T-B based sintered magnet material by sintering a molded body at a temperature of 1,000° C. or higher and 1,100° C. or lower, and then performing (condition b) below:

(Condition b) temperature dropping to 500° C. at 10° C./min or less after performing a first heat treatment of holding at a first heat treatment temperature of 800° C. or higher and 950° C. or lower, the R-T-B based sintered magnet material comprising:

27.5% by mass or more and 34.0% by mass or less of R, (R being at least one element of rare earth elements and indispensably containing Nd);

0.85% by mass or more and 0.93% by mass or less of B, 0.20% by mass or more and 0.70% by mass or less of Ga, 0.05% by mass or more and 0.50% by mass or less of Cu, and 0.05% by mass or more and 0.50% by mass or less of Al, with the balance being T (T being Fe and Co, and 90% or more of T in terms of a mass ratio being Fe) and inevitable impurities, the R-T-B based sintered magnet material satisfying inequality expressions (1) and (2) below:

$$[T]-72.3[B]>0 \quad (1)$$

$$([T]-72.3[B])/55.85<13[Ga]/69.72 \quad (2)$$

where [T] is a T content in % by mass, [B] is a B content in % by mass, and [Ga] is a Ga content in % by mass; and 2) a heat treatment step of performing a second heat treatment by heating the R-T-B based sintered magnet material to a second heat treatment temperature of 650° C. or higher and 750° C. or lower, after performing (condition b) without cooling to a temperature of lower than 400° C., and then cooling the R-T-B based sintered magnet material to 400° C. at 5° C./min or more.

2. The method for manufacturing an R-T-B based sintered magnet according to claim 1, wherein, in the step 2), the R-T-B based sintered magnet material is cooled from the second heat treatment temperature to 400° C. at 15° C./min or more.

3. The method for manufacturing an R-T-B based sintered magnet according to claim 1, wherein, in the step 2), the R-T-B based sintered magnet material is cooled from the second heat treatment temperature to 400° C. at 50° C./min or more.

4. The method for manufacturing an R-T-B based sintered magnet according to claim 1, wherein the R-T-B based sintered magnet material includes 1.0% by mass or more and 10% by mass or less of Dy and/or Tb.

5. The method for manufacturing an R-T-B based sintered magnet according to claim 1, wherein, in the step 1) (condition b), after sintering and cooling to a temperature lower than the first heat treatment temperature, the first heat treatment is performed by heating to the first heat treatment temperature.

6. The method for manufacturing an R-T-B based sintered magnet according to claim 1, wherein, in the step 1) (condition b), after sintering and cooling to the first heat treatment temperature, the first heat treatment is performed.

7. The method for manufacturing an R-T-B based sintered magnet according to claim 1, which comprises a low-temperature heat treatment step of heating the R-T-B based sintered magnet after the step 2) to a low-temperature heat treatment temperature of 360° C. or higher and 460° C. or lower.

8. The method for manufacturing an R-T-B based sintered magnet according to claim 2, wherein the R-T-B based sintered magnet material includes 1.0% by mass or more and 10% by mass or less of Dy and/or Tb.

9. The method for manufacturing an R-T-B based sintered magnet according to claim 3, wherein the R-T-B based sintered magnet material includes 1.0% by mass or more and 10% by mass or less of Dy and/or Tb.

* * * * *